US007018258B2

(12) United States Patent
McLarty

(10) Patent No.: US 7,018,258 B2
(45) **Date of Patent: *Mar. 28, 2006**

(54) FLOTATION DEVICE

(76) Inventor: L. Scott McLarty, 1824 Linwood Ave., Appleton, WI (US) 54914

( * ) Notice: Subject to any disclaimer, the term of this patent is extended or adjusted under 35 U.S.C. 154(b) by 0 days.

This patent is subject to a terminal disclaimer.

(21) Appl. No.: 10/876,853

(22) Filed: Jun. 25, 2004

(65) Prior Publication Data

US 2004/0235375 A1 Nov. 25, 2004

Related U.S. Application Data

(63) Continuation-in-part of application No. 10/322,968, filed on Dec. 18, 2002, now Pat. No. 6,755,708.

(51) Int. Cl.
*B63C 9/105* (2006.01)

(52) U.S. Cl. ..... 441/97; 441/113

(58) Field of Classification Search ..... 441/95, 441/97, 100, 106, 108, 113
See application file for complete search history.

(56) References Cited

U.S. PATENT DOCUMENTS

| | | | | |
|---|---|---|---|---|
| 1,367,225 | A | 2/1921 | Barker | |
| 3,716,882 | A | 2/1973 | Middleton, Jr. et al. | |
| 4,626,221 | A | 12/1986 | Rocco | |
| 5,373,833 | A | 12/1994 | D'Andrade | |
| 5,690,524 | A | 11/1997 | Salvemini | |
| 5,710,989 | A | 1/1998 | Flood | |
| 5,746,633 | A | 5/1998 | Jeffrey | |
| 5,765,500 | A | 6/1998 | Norbo | |
| 5,800,228 | A | 9/1998 | Hernandez | |
| 5,820,431 | A | 10/1998 | Biesecker | |
| 5,839,932 | A * | 11/1998 | Pierce et al. | 441/80 |
| 5,857,881 | A | 1/1999 | Zippel, Sr. | |
| 6,036,559 | A | 3/2000 | Arnold et al. | |
| 6,755,708 | B1 * | 6/2004 | McLarty | 441/95 |

* cited by examiner

*Primary Examiner*—Stephen Avila
(74) *Attorney, Agent, or Firm*—Quarles & Brady LLP

(57) ABSTRACT

A flotation device for use with objects includes a bladder forming part of an inflatable assembly having an inflatable volume defined by a first wall and a second wall sealed about a periphery. An inflation valve is in fluid communication with the inflatable volume through one of the walls, and the inflatable assembly wraps over the inflation valve to protect the inflation valve.

17 Claims, 7 Drawing Sheets

FIG. 3
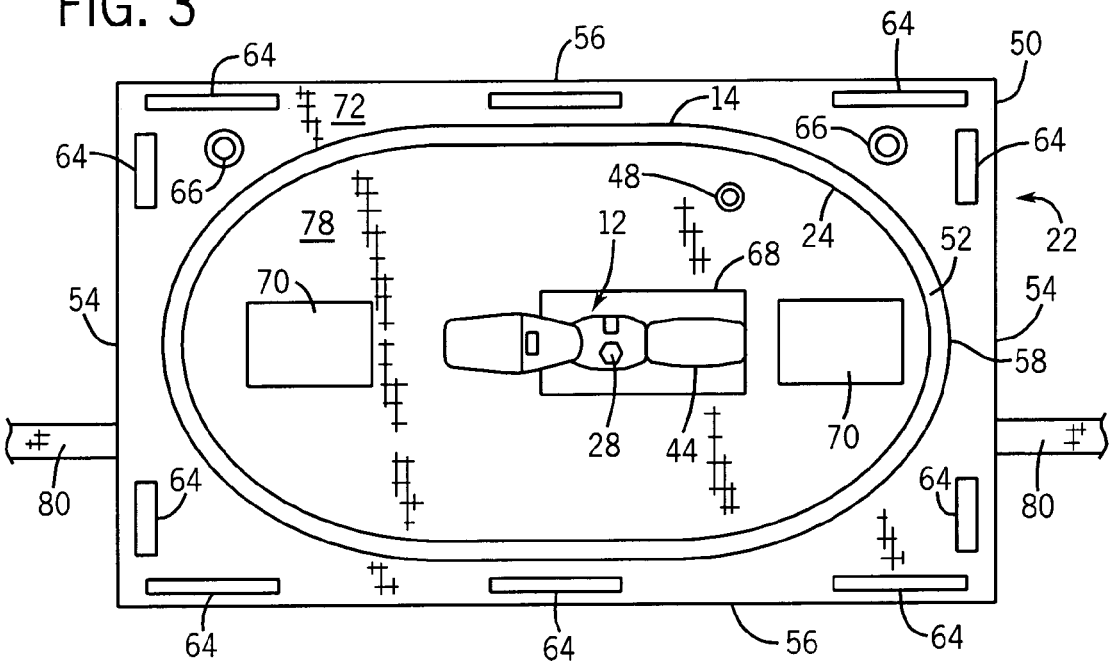
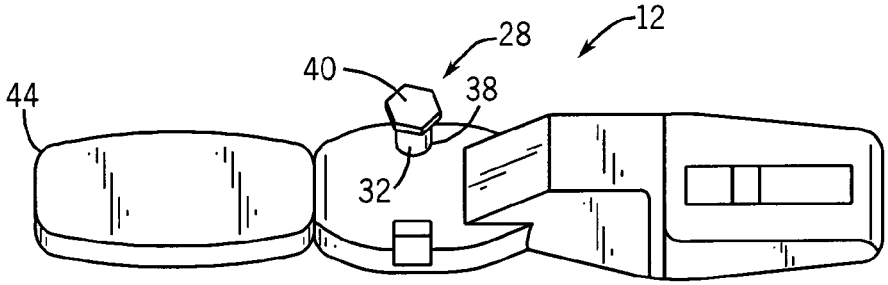
FIG. 4
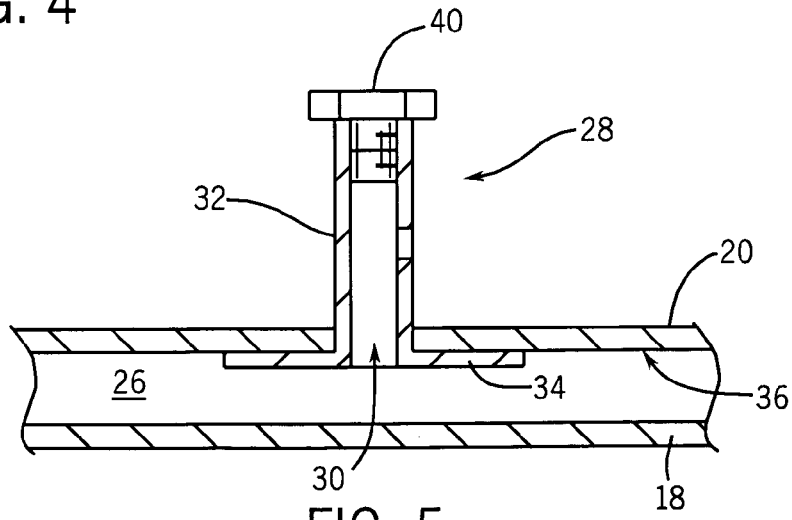
FIG. 5

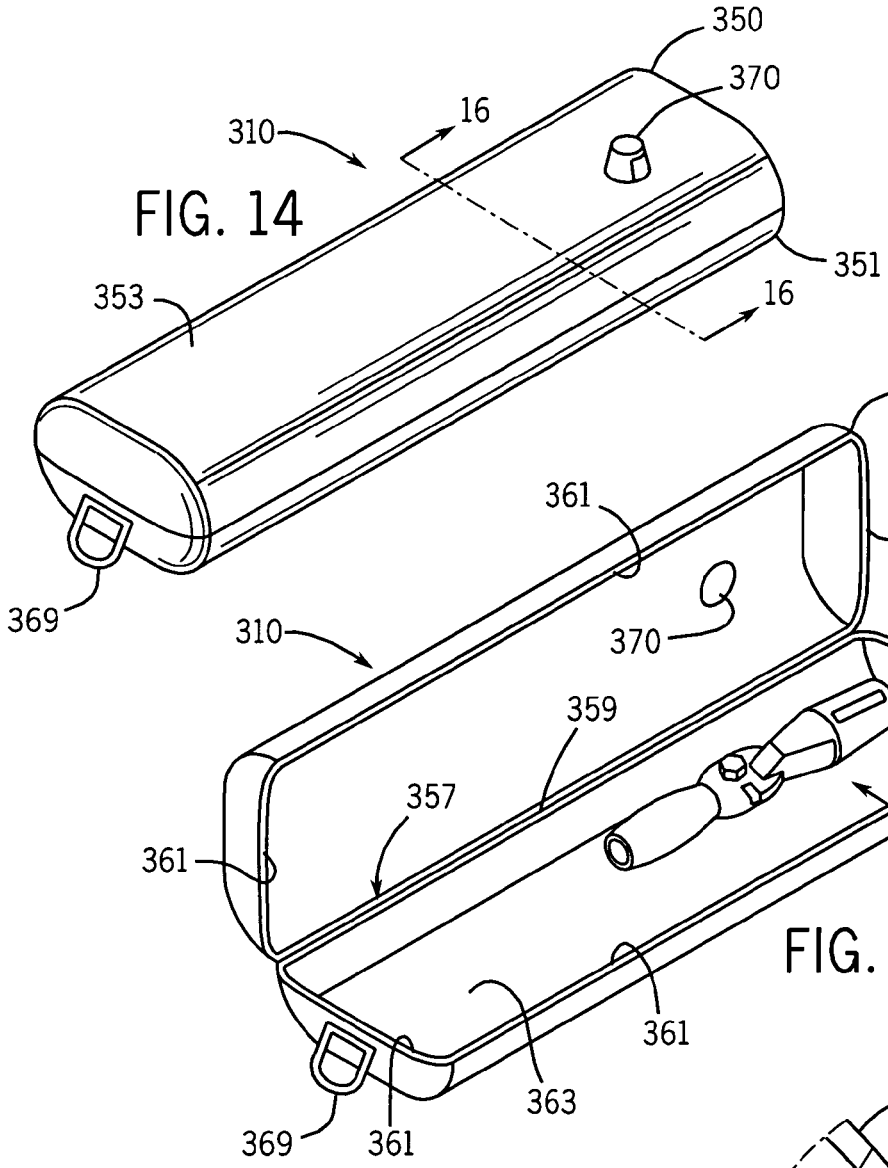
FIG. 14
FIG. 15
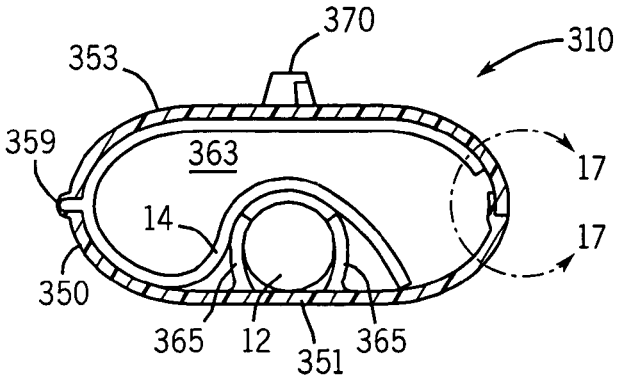
FIG. 16
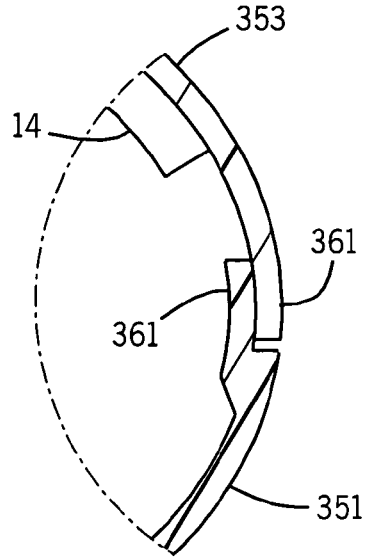
FIG. 17

FLOTATION DEVICE

CROSS REFERENCES TO RELATED APPLICATIONS

This application is a continuation-in-part of U.S. patent application Ser. No. 10/322,968 filed on Dec. 18, 2002 and issued as U.S. Pat. No. 6,755,708 on Jun. 29, 2004.

STATEMENT REGARDING FEDERALLY SPONSORED RESEARCH

Not Applicable

BACKGROUND OF THE INVENTION

The field of invention is flotation devices, and more particularly, self-inflating flotation devices attachable to objects.

Nonfloating objects which are used in the vicinity of bodies of water, such as shotguns used for duck hunting, can fall into the water and sink to the bottom of the body of water. If the water is very murky or deep, the shotgun can be lost forever. Flotation devices, such as life vests, are provided for individuals operating in the vicinity of bodies of water. Unfortunately, due to the shape of these life vests, they are not adaptable for use with objects, such as shotguns, and other nonfloating objects.

Flotation devices have been developed for use with submerged articles, such as disclosed in U.S. Pat. No. 6,036,559, which include an inflatable balloon stuffed in a casing with a water actuated inflation valve and compressed gas cartridge. The casing is directly attached to the object, such as a fishing pole. When the fishing pole falls into the water, the balloon inflates and ejects a cap enclosing the balloon in the casing. The inflated balloon rises to the water surface while the cap falls to the bottom of the body of water. As a result, the single purpose device can only be used once.

Another similar device disclosed in U.S. Pat. No. 5,857,881 discloses flotation device specifically for fishing rods. This device also includes a hard case for holding the contain flotation device components which inherently prevents inadvertent actuation. Unfortunately, the hard case increases the device cost.

In addition to the above deficiencies in both of the above described flotation devices for objects, the prior art devices merely add weight to the fishing rod, and are of no use until the user makes a mistake and drops the fishing rod in the water. As a result, if the user is fortunate, the device is never used. Therefore, a flotation device which provides utility other than in adversity would be further advantageous.

BRIEF SUMMARY OF THE INVENTION

The present invention provides a flotation device for use with objects. The device includes a bladder forming part of an inflatable assembly having an inflatable volume defined by a first wall and a second wall sealed about a periphery. An inflation valve is in fluid communication with the inflatable volume through at least one of the walls, and the inflatable assembly wraps over the inflation valve to protect the inflation valve.

A general objective of the present invention is to provide a flotation device including an inflation valve and an inflatable assembly, in which the inflatable assembly protects the inflation valve. This objective is accomplished by providing a flotation device having an inflatable assembly which wraps over the inflation valve to protect the inflation valve.

The foregoing and other objectives and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 3 is bottom view of the inflatable device of FIG. 1 in an unwrapped position;

FIG. 4 is a detailed view of the water actuated inflation valve of FIG. 3;

FIG. 5 is a cross sectional view of the fill tube of FIG. 4;

FIG. 14 is a perspective top view of another alternative flotation device incorporating the present invention;

FIG. 15 is a perspective view of the device of FIG. 14 with the first and second portions of the case disengaged and the bladder removed;

FIG. 16 is a cross sectional view along line 16—16 of FIG. 14; and FIG. 17 is a detailed view along line 17—17 of FIG. 16.

DETAILED DESCRIPTION OF THE PREFERRED EMBODIMENTS

Figure 1:
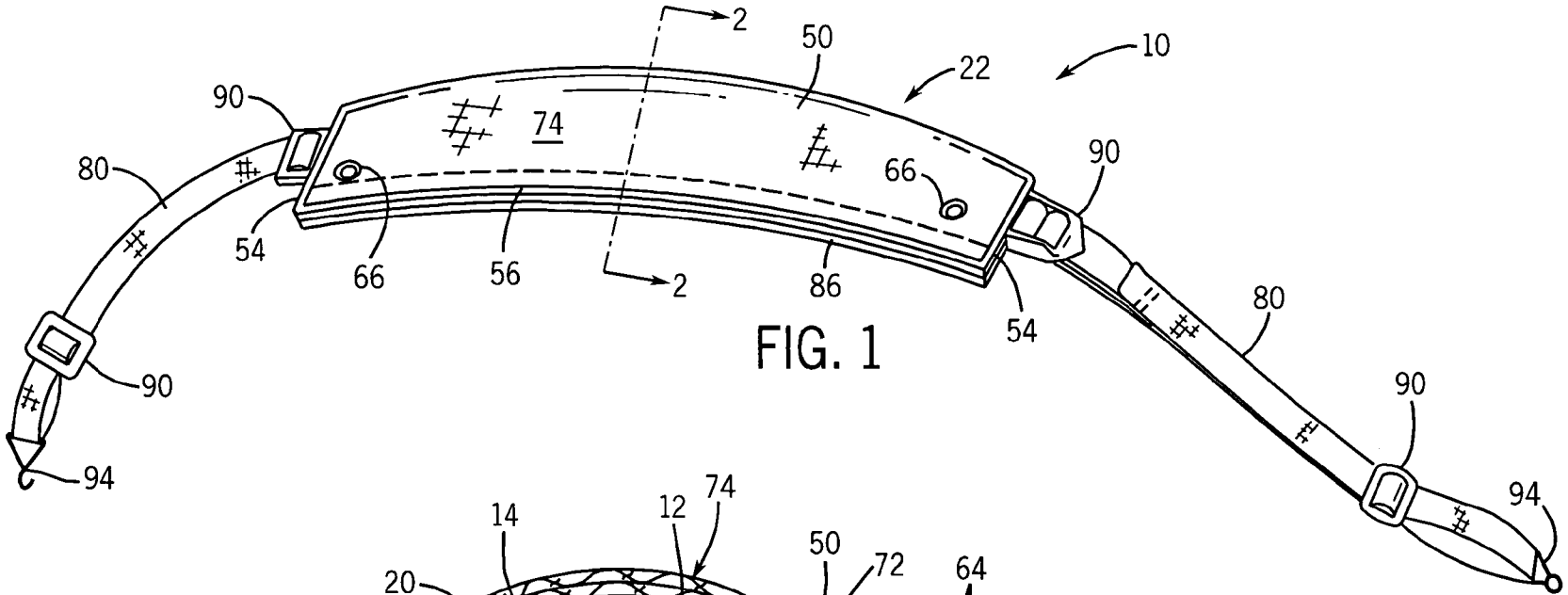
FIG. 1 is a perspective view of an inflatable device incorporating the present invention.

A flotation device 10 shown in FIGS. 1–5 is attachable to an object, such as sporting equipment, a backpack, cooler, tackle box, GPS device, camera, binocular, first aid kit, pet marker, and the like, which can inadvertently fall into a body of water automatically inflates to facilitate retrieval of the object from the water. The flotation device 10 includes a water actuated inflation valve 12 which releases a compressed gas into an inflatable bladder 14 to either raise the object close to the water surface or identify the location of the object in the water. The flotation device 10 can form part of a sling which can be used to carry the object.

The flotation device 10 includes the flexible inflatable bladder 14 having an inner wall 18 and an outer wall 20 forming part of an inflatable assembly 22. The inner wall 18 includes a gas impervious sheet of material, such as a heat sealable urethane coated nylon. The outer wall 20 includes a gas impervious sheet of material facing the inner wall 18, and is joined to the inner wall 18 about a periphery defined by a seam 24 joining the two walls 18, 20 to form an inflatable volume 26 therebetween. Preferably, the walls 18, 20 are formed from the same material and joined at the seam 24 using methods known in the art, such as RF welding, heat sealing, and the like, which forms an air tight seal joining the two walls 18, 20.

A fitting 28 providing a fluid passageway into the inflatable volume 26 extends through a fill opening 30 formed in the inner wall 18. The fitting 28, such as a brass manifold valve available from Halkey-Roberts Corporation in St. Petersburg, Fla., includes a fill tube 32 having a flange 34 disposed inside the inflatable volume 26 and sealingly joined to an inner surface 36 of the inner wall 18. The flange 34 is sealingly joined to the inner wall 18, using methods such as RF welding, heat sealing, and the like, to prevent gas from escaping from the inflatable volume 26 through the opening 30.

The fill tube 32 extends through the fill opening 30 out of the inflatable volume 26, and is received in a through hole 38 formed in the water actuated inflation valve 12 for receiving the tube 32 in fluid communication with released compressed gas. A threaded cap 40 threadably received in the fill tube end clamps the valve 12 onto the tube 32. Of course, the valve 12 can be directly sealingly joined to the fill opening 30 without departing from the scope of the invention.

Figure 2:
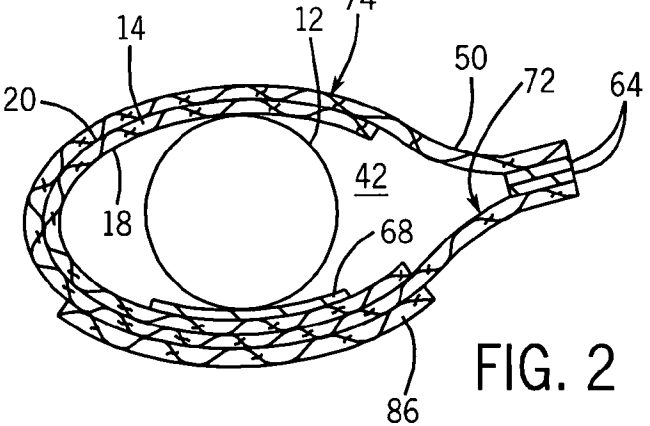
FIG. 2 is a cross sectional view along line 2—2 of FIG. 1.

As shown in FIG. 2, the inflatable assembly 22 wraps over the water actuated inflation valve 12 joined to the inner wall 18 to form a protective cavity 42 which protects the valve 12 from incidental contact with water. Preferably, the bladder 14 is folded in half over the valve 12 to form the protective cavity 42. The bladder 14, however, can be rolled, folded in thirds, and the like, to wrap over the valve 12 and form the protective cavity 42 without departing from the scope of the invention.

The water actuated inflation valve 12 can be any valve known in the art which is in fluid communication with the inflatable volume 26 through the fill opening 30 to inflate the bladder 14 upon immersion of the flotation device 10 in water. Preferably, the valve 12 is a commercially available valve, such as an auto inflator assembly available from Halkey-Roberts Corporation. Preferably, the valve 12 includes a source of compressed gas, such as a $CO_2$ cartridge 44, coupled to a valve 12, and the $CO_2$ cartridge 44 is pierced to release the gas into the inflatable volume 26 upon immersion of the valve 12 in water. As is known in the art, the $CO_2$ cartridge 44 can be threadably coupled to the valve 12 for easy replacement of a spent cartridge.

A dump valve 48 in fluid communication with the inflatable volume 26 provides an exhaust path for compressed gas in the inflatable volume 26. The dump valve 48 sealingly extends through the bladder inner wall 18, and is selectively opened by the user to deflate the bladder 14 after it has been inflated and the object retrieved from the water. Preferably, the dump valve 48 is a commercially available valve such as available from Halkey-Roberts Corporation. Although porting the dump valve 48 through the inner wall 18 is preferred, the dump valve 48 can be in fluid communication with the inflatable volume 26 through the bladder outer wall 20 without departing from the scope of the invention.

A flexible cover 50 is joined to the bladder 14 to form part of the inflatable assembly 22 and protect the bladder 14 from damage. The cover 50 can be joined to the bladder 14 using methods known in the art, such as the methods described above for joining the bladder inner and outer walls 18, 20 together, and further including joining the cover 50 to excess bladder material 52 not defining the inflatable volume 26 such as by sewing, releasable fasteners, adhesives, and the like without departing from the scope of the invention.

The cover 50 can be any suitable material, such as fabric, leather, plastic, and the like, which can protect the bladder 14. Preferably, the cover 50 is rectangular having opposing ends 54 joined by sides 56 which extend past the bladder periphery 58 and define edges of the protective cavity 42. Although a rectangular cover 50 is preferred, the cover 50 can have any shape, such as circular, oval, polygonal, and the like with straight and/or curved edges, or deleted completely without departing from the scope of the invention.

The edges 54, 56 of the protective cavity 26 are held together by releasable fasteners 64 which hold the bladder 14 over the water actuated inflation valve 12 until the bladder 14 begins to inflate. Preferably, the releasable fasteners 64 are hook and loop fasteners, such as Velcro®, which releasably attaches the edges 54, 56 of the protective cavity 42 together. Hook and loop fasteners are preferred, however, other releasable fasteners can be used, such as snaps, releasable adhesives, breakable threads, and the like without departing from the scope of the invention. Although a plurality of fasteners 64 is shown, only one releasable fasteners is required to secure the protective cavity 42 over the water actuated inflation valve 12.

Figure 6:
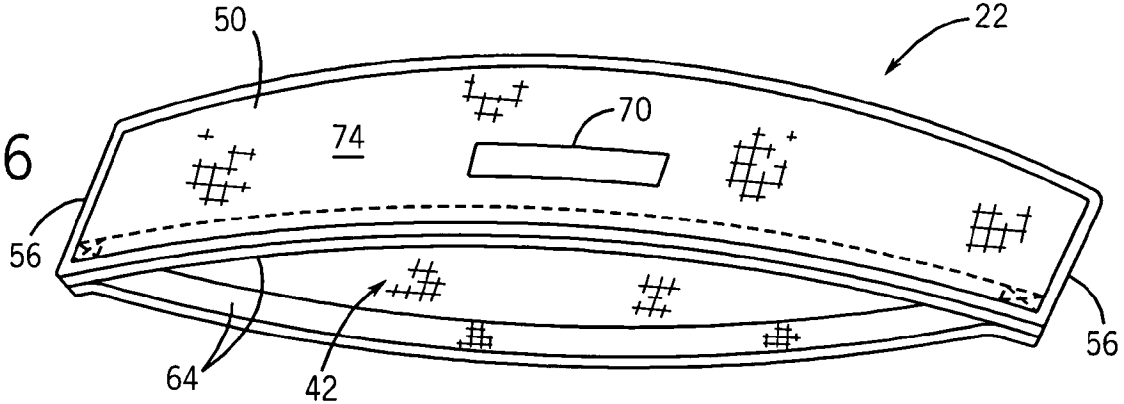
FIG. 6 is an alternative inflatable assembly incorporating the present invention.

The releasable fasteners 64 are preferably fixed proximal the edges 54, 56 of the cover, such that the fasteners 64 are engaged when the inflatable assembly 22 wraps over the water actuated inflation valve 12. Of course, if the cover 50 is not provided, the releasable fasteners 64 can be fixed to the bladder 14. Although releasably securing all of the free edges 54, 56 of the protective cavity 42 using a plurality of releasable fasteners 64 is disclosed, as shown in FIG. 6 some free edges of the protective cavity 42, such as the cover ends 56, can be permanently joined together, such as by sewing, RF welding, heat sealing, and the like, without departing from the scope of the invention, as long as the protective cavity 42 can be opened to allow expansion of the inflatable bladder 14.

Inflation of the bladder 14 (i.e. the release of compressed gas into the inflatable volume 26) forces the releasable fasteners 64 to open and allow the bladder 14 to expand. Of course, the location of the releasable fasteners 64 on, or around, the inflatable assembly 22 depends upon the manner in which the inflatable assembly 22 wraps over the water actuated inflation valve 12. For example, if the inflatable assembly 22 is folded in half over the valve 12, the releasable fasteners 64 can be fixed to the inner surface 72 of the cover 50. If the inflatable assembly 22 is folded in thirds, or rolled, over the water actuated inflation valve 12, releasable fastener 64 can be fixed to both an inner and outer surface 72, 74 of the cover 50 or the inner and outer walls 18, 20 of the bladder 15 if a cover 50 is not provided.

An actuation opening 66 formed through the inflatable assembly 22 provides a water passageway for water into the protective cavity 42. Preferably, the opening 66 is defined by a small grommet (i.e. a grommet that is less than 0.5 inches in diameter) fixed to the cover 50 adjacent the inflatable bladder 14. Of course, if the protective cavity 42 is not tightly sealed by the releasable fasteners 64, water can easily enter the protective cavity 42 when the inflatable assembly 22 is immersed in the water, and the opening 66 is not required. Although two actuation openings 66 through the cover 50 are shown, one or more actuation openings 66 can be provided depending upon the desired response time of the water actuated inflation valve 12 to immersion of the flotation device 10 in the water. The actuation openings 66 can be covered by a removable tape prior to use, such as during shipping or prior to sale to a retail customer, to avoid inadvertent actuation of the inflation valve 12.

A protective material 68 interposed between the bladder inner wall 18 and water actuated inflation valve 12 protects the bladder inner wall 18 from damage due to the cold temperatures caused by rapid release of the compressed gas through the valve 12 upon immersion of the valve 12 in water. The protective material 68 is preferably formed from a heat sealable urethane and joined to a portion of the inner wall 18 surrounding the fill opening 30 using the above disclosed methods known in the art. Of course, other methods for protecting the inner wall 18 from damage caused by the cold temperatures can be provided, such as by slipping a water permeable sock (not shown) over the valve 12 which thermally separates the valve 12 from bladder inner wall 18, providing a cover, or strip of material, over the bladder inner wall 18 which thermally separates the valve 12 from the inner wall 18, and the like, without departing from the scope of the invention.

A visually enhancing material 70 joined to the inflatable assembly 22 inside the protective cavity 42, such as on an exterior surface 78 of the bladder inner wall 18 or the inner surface 72 of the cover 50, is exposed when the flotation device 10 is immersed in water and the bladder 14 inflates. The visually enhancing material 70 can be reflective, fluorescent, multi-colored, glow-in-the-dark, and the like, which passively enhances the visibility of the flotation device. Of course, visually enhancing material 70 can also be provided on an exterior surface of the inflatable assembly 22, such as an exterior surface 74 of the cover 50 (shown in FIG. 6) to enhance visibility of the user transporting the flotation device 10. Moreover, in one alternate embodiment, the cover 50 is made from the visually enhancing material 70 to enhance the visibility of the flotation device 10.

In a preferred embodiment, the visually enhancing material 70 is a reflective material, such reflective tape, heat sealable reflective material, and the like joined to the inflatable assembly 22, without departing from the scope of the invention. Advantageously, the exposed reflective visually enhancing material 70 reflects light, such as from a flashlight, when the flotation device 10 is dropped in the water in low light conditions.

Straps 80, such as formed from nylon webbing, leather, fabric, rubber, and the like, fixed to the inflatable assembly 22 are attachable to the object. Advantageously, the straps 80 form part of a sling or handle for carrying the object, such as a shot gun. Preferably, the straps 80 are provided with sufficient length, such that the flotation device 10 can be used as a sling connected to the object which can be supported by the user's shoulder when carrying the object using the flotation device 10. Buckles 90 are provided to adjust the strap length, as desired by the user. Hooks 94, loops, or other fastening devices known in the art, are fixed to the free ends of the straps for connecting to the object.

The straps 80 can be fixed directly to the cover 50 or bladder 14, such as by sewing, RF welding, heat sealing, and the like. Although a pair of straps 80 is shown, only one strap can be used without departing from the scope of the invention. If one strap 80 is used, the one strap can have one end fixed to the inflatable assembly 22 and an opposing end available for connection to the object, or the one strap can be fixed to the inflatable assembly between the two strap ends which are both connectable to the object.

Figure 7:
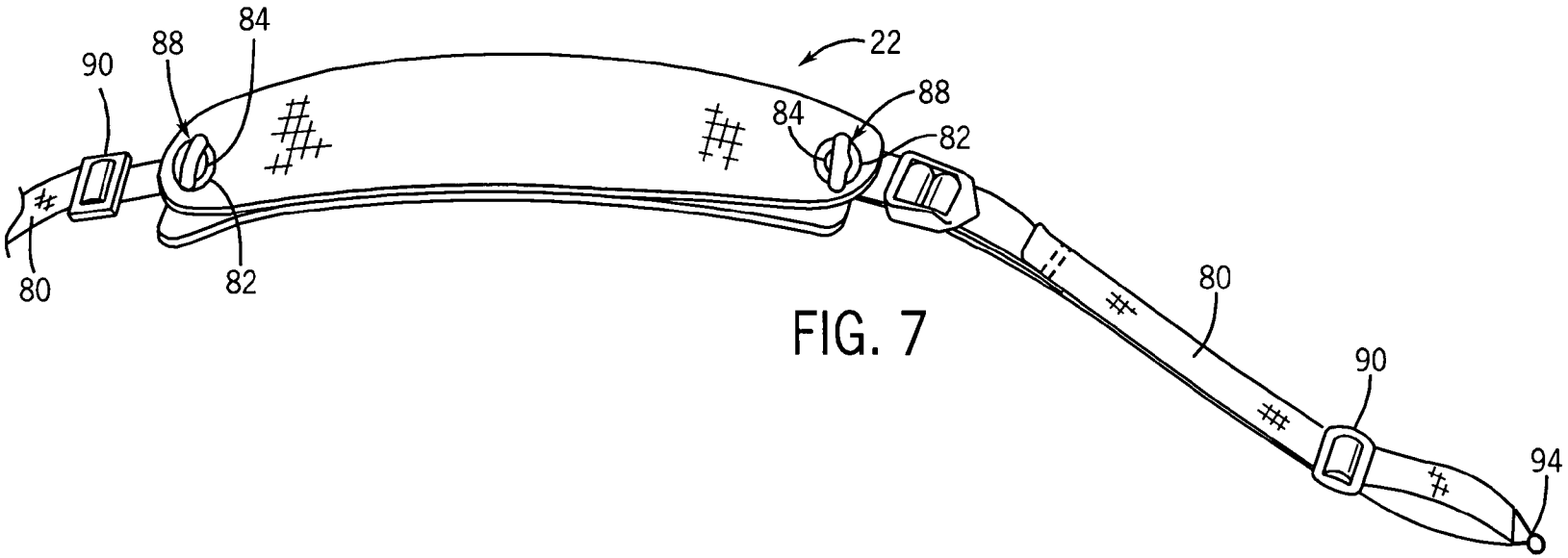
FIG. 7 is a perspective top view of an alternative flotation device incorporating the present invention.
Figure 8:
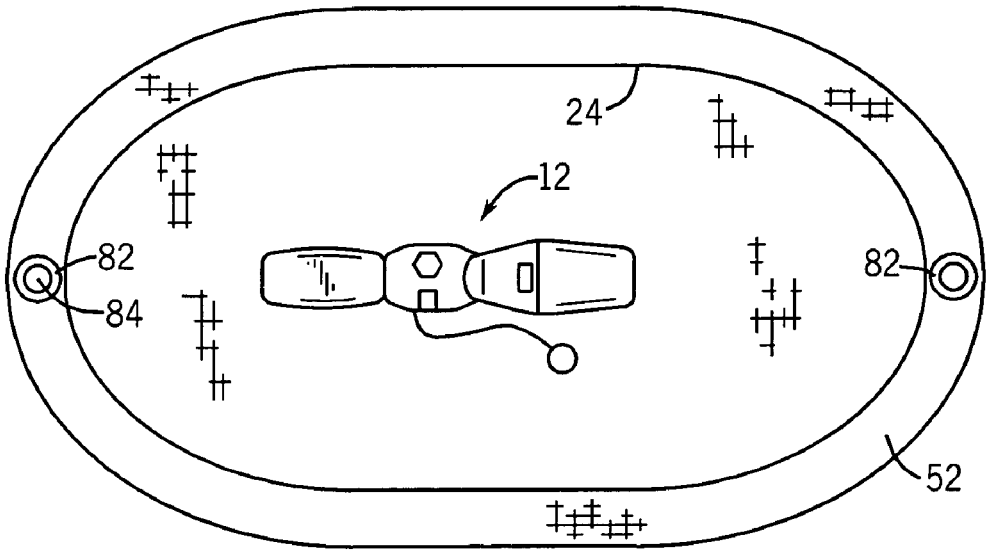
FIG. 8 is a bottom view of another alternative inflatable assembly in an unwrapped position incorporating the present invention.

In an alternative embodiment shown in FIG. 7, the straps 80 are connected to the inflatable assembly using grommets 82 forming through holes 84 in the cover 50 or excess bladder material 52 (shown in FIG. 8) not defining the inflatable volume 26. The straps 80 are fixed to the inflatable assembly 22 using fasteners 88, such as hooks, bolts, rivets, or other engagement devices, which can fix the straps 80 to the inflatable assembly 20 through the through holes 84.

Referring back to FIGS. 1 and 2, padding 86 fixed to the exterior surface 74 of the cover 50 can be provided to reduce the strain on the user's shoulder supporting the object using the flotation device 10. The padding 86 can be any cushioning material, such as a compressible material, foam, fabric stuffing, and the like. Of course, the pad 86 can be fixed to the strap 80, or anywhere in or on the inflatable assembly 22, to reduce the strain on the user carrying the object using the flotation device 10 without departing from the scope of the invention.

In use, the flotation device 10 is attached to the object, such as a shotgun, using the straps 80. When the shotgun falls into the body of water and the flotation device 10 is immersed in the water, the water seeps into the protective cavity 42 covering the water actuated inflation valve 12 past the releasable fasteners 64 and through the actuation opening 66. The water actuates the water actuated inflation valve 12 to release the compressed gas from the compressed gas cartridge 44 into the inflatable volume 26 which inflates the bladder 14. The inflating bladder 14 causes the releasable fasteners 66 to releases and allow further expansion of the bladder 14 which exposes the visually enhancing material 70.

Once the bladder 14 has inflated sufficiently to provide sufficient buoyancy to begin rising to the surface of the water, the bladder 14 rises to the water surface for retrieval of the shotgun by the user. The flotation device 10 can be reused by replacing the expended compressed gas cartridge 44, recovering the water actuated inflation valve 12 in the protective cavity 42, and refastening the releasable fasteners 66 at the protective cavity edges 52, 54.

In the following alternate embodiments disclosed in FIGS. 9–17, common elements are referenced using the same reference numbers used above. Moreover, specific features of the following alternate embodiments are not necessarily limited to the specific embodiment in which it is described, and may be used in combination with any of the embodiments disclosed herein.

Figure 9:
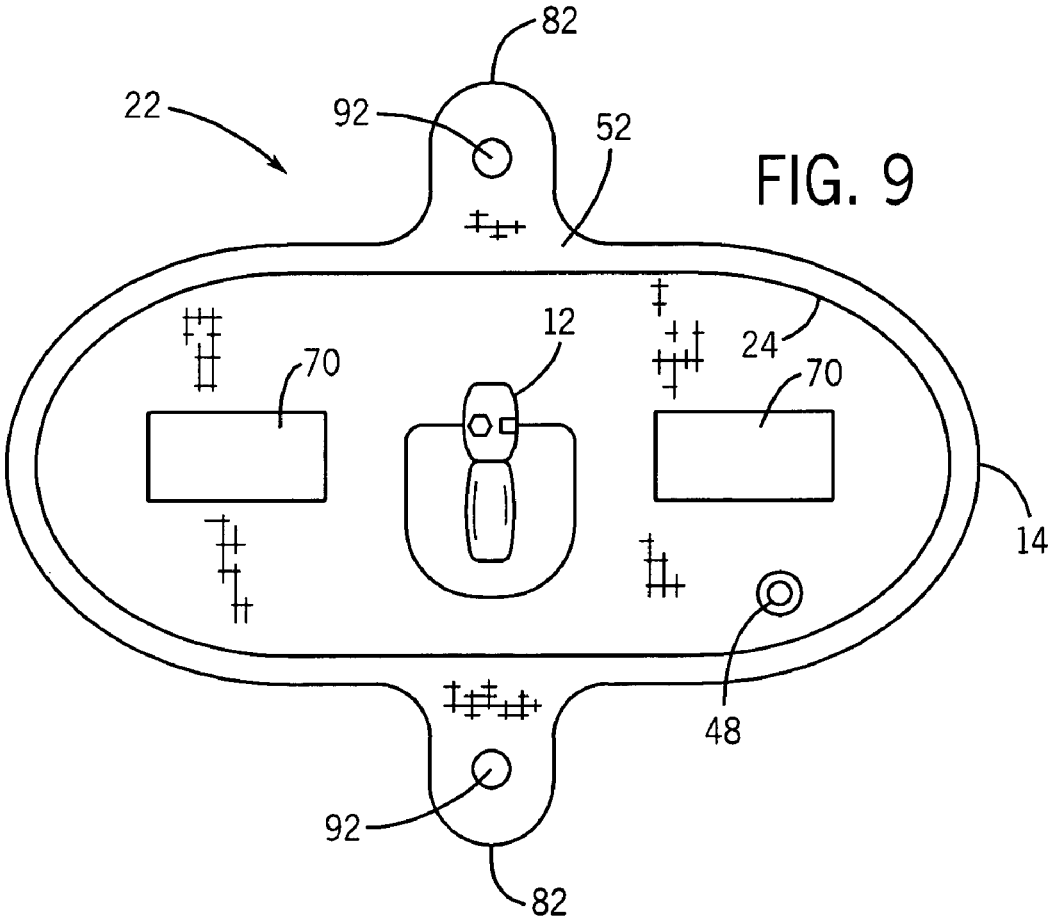
FIG. 9 is a bottom view of yet another alternative inflatable assembly in an unwrapped position incorporating the present invention.

In an alternative embodiment, disclosed in FIGS. 9, tabs 82 forming part of the inflatable assembly 22 extend from the bladder 14 for attachment to straps and/or a cover. The releasable fasteners could also be fixed to the tabs 82 to releasably fasten the protective cavity over the water actuated inflation valve 12. Preferably, the tabs 82 are formed in excess bladder material 52 not defining the inflatable volume. Through holes 92 can be formed in the tabs 82 to facilitate connecting the tabs to the cover, straps, or releasable fasteners. Of course, if a cover 50, such as disclosed above, is provided, the tabs 82 can be formed as, or fixed to, part of the cover without departing from the scope of the invention. Instructions 71 for refolding the inflatable assembly 22, recharging the valve 12, and the like, can be imprinted on the bladder 14, or otherwise affixed to the inflatable assembly 22 to simplify reuse.

Figure 10:
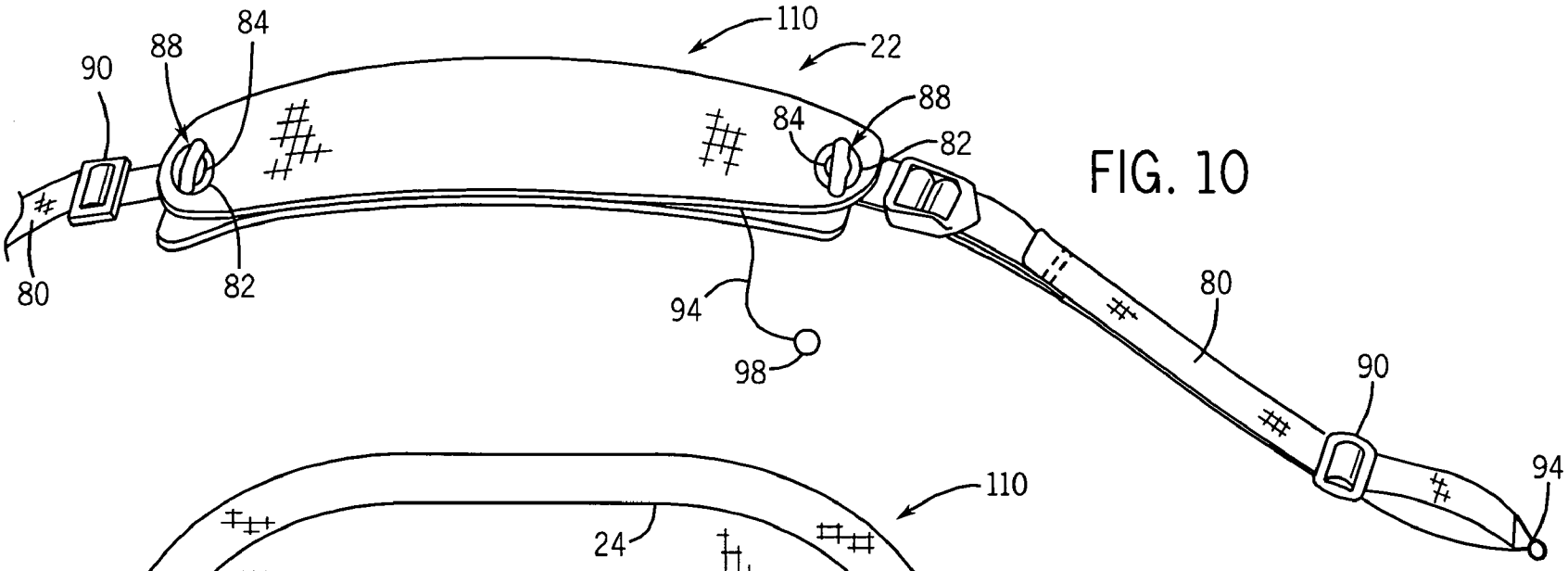
FIG. 10 is a perspective top view of another alternative flotation device incorporating the present invention.
Figure 11:
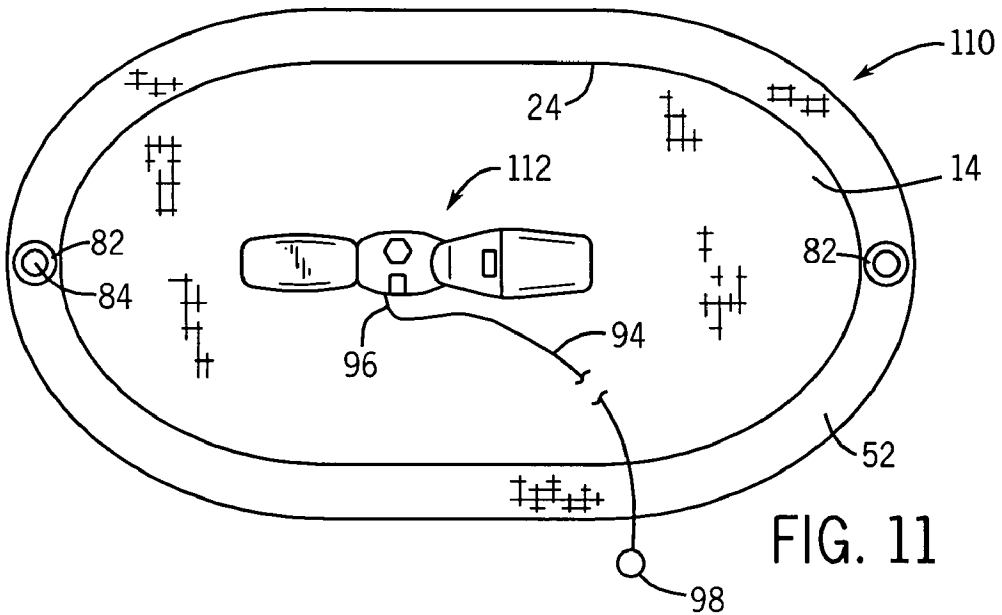
FIG. 11 is a bottom view of the device of FIG. 10.

In another embodiment shown in FIGS. 10 and 11, a flotation device 110, such as disclosed above, has an inflation valve 112 that is actuated by a pull cord 94 instead of a water actuated inflation valve. The pull cord 94 has one end 96 connected to the inflation valve 112, such as by a detachable pin (not shown). Upon disconnection of the one end 96 from the inflation valve 112, the inflation valve 112 opens to inflate the bladder 14. A second end 98 of the pull cord 94 is connectable to the user, an article of clothing worn by the user, or some other object.

In use, if a user is immersed in water and loses contact with the flotation device 110, or an object connected to the flotation device 110, once the flotation device 110 reaches the limits of the pull cord 94 and disconnects from the inflation valve 112, the bladder 14 in the flotation device 110 inflates to allow easy recovery of the object connected to the flotation device 110. Advantageously, the pull cord 94 disconnects from the inflation device 110 to activate the inflation valve 112 in order to prevent the object from dragging the user beneath the water.

Figure 12:
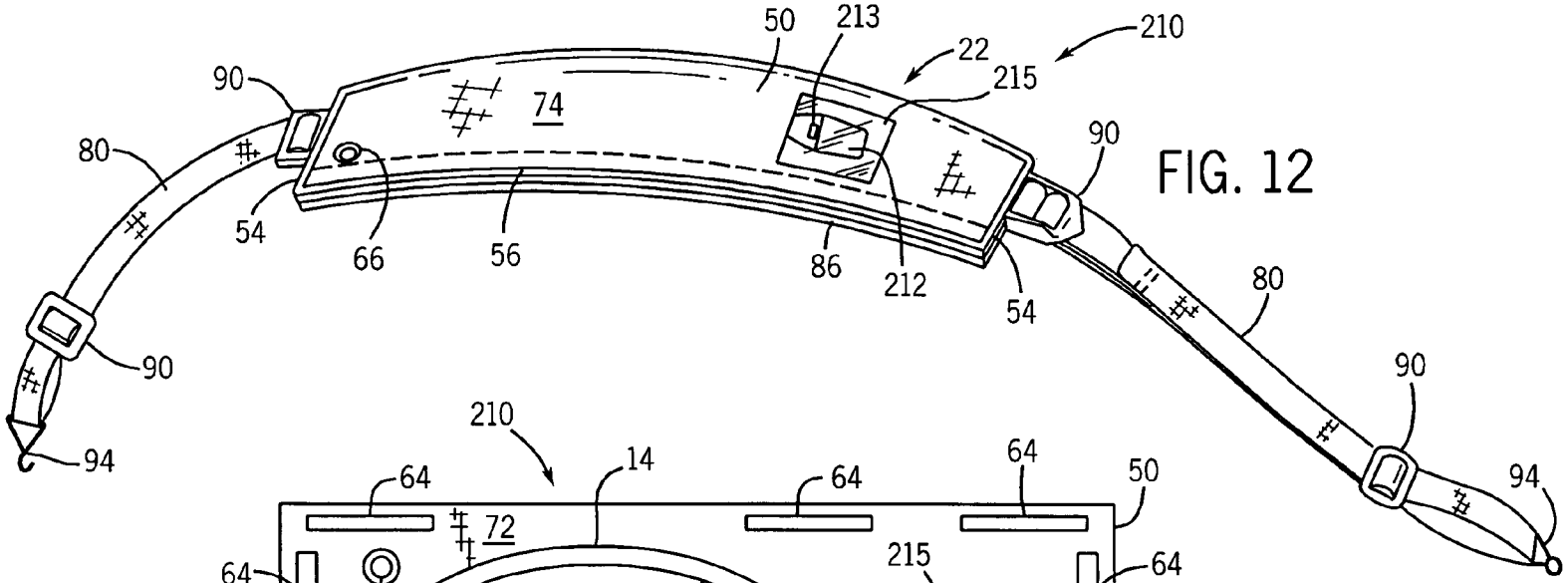
FIG. 12 is a perspective top view of another alternative flotation device incorporating the present invention.
Figure 13:
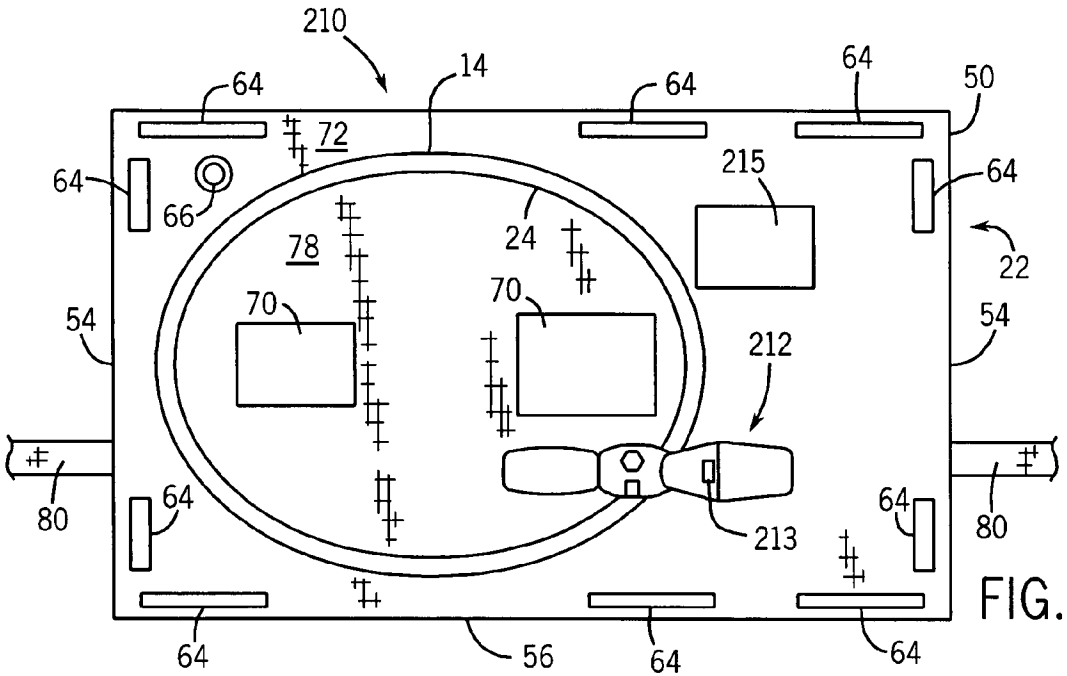
FIG. 13 is a bottom view of the device of FIG. 12.

In another embodiment of the present invention shown in FIGS. 12 and 13, a flotation device 210, such as disclosed above, includes an inflation valve 212 having at least two states, an operable state and an inoperable state. Preferably, the states are user selectable which allows the user to immerse the flotation device 210 equipped with a water actuated inflation valve 212 in the water without actuating the inflation valve 212 and inflating the bladder 14. Inflation valves having internal mechanisms that change the state of the inflation valve can be used. In one embodiment, however, a water tight wrap, such as plastic, that wraps around a portion of a water actuated inflation valve to prevent water from entering the valve causing actuation can be used to place the water actuated inflation valve in the inoperable state. The water tight wrap is removed by a user to change the state of the water actuated inflation valve from the inoperable state to the operable state.

A status indicator 213 on the inflation valve 212 can be provided that indicates the status of the inflation valve 212. The status of the inflation valve 212 can include which state the inflation valve 212 is in (i.e. whether it is in the operable or inoperable state), the pressure of the compressed air for inflating the bladder 14, and the like.

A window 215 formed through the cover 50, such as by covering an opening in the cover 50 with a see through material, such as a transparent plastic, allows a user to view the inflation valve 212. Preferably, the window 215 allows a user to view the status indicator 213 of the inflation valve 212, or whether plastic is wrapped around the inflation valve 212 rendering it inoperable, and determine the status of the inflation valve 212 without opening up the flotation device 210 by unwrapping the cover 50 to expose the inflation valve 212.

In another embodiment of the present invention shown in FIGS. 14–17, a flotation device 310 includes a hard cover 350 wrapped over the bladder 14, such that the bladder 14 is enclosed. The hard cover 350 forms part of an inflatable assembly with the bladder 14, and is formed from a hard material, such as plastic, carbon fiber, metal, and the like, which provides greater protection to the inflation valve 12 and bladder 14 than a soft cover.

In the embodiment disclosed in FIGS. 14–17, the hard cover 350 is a case formed from molded plastic having a first portion, or base 351, joined to a second portion, or lid 353. Preferably, adjacent edges 357 of the base 351 and lid 353 are joined by a living hinge 359. The remaining edges 361 of the base 351 and lid 353 are sealingly engaged, such as by friction, to form a water tight enclosure 363 around the bladder 14 and inflation valve 12. Although joining the lid and base by a hinge is disclosed, the lid can be separable from the base without departing from the scope of the invention.

Additional features of the case can be provided. For example, an O-ring, or other sealing material can be provided between the base and lid to form a water tight enclosure without departing from the scope of the invention. In addition, one or more attachment points 369 can be provided that are fixed to the cover 350 for attaching an object that does not float. Although a lid formed as a single piece is disclosed, the lid can be formed from two or more pieces without departing from the scope of the invention.

The bladder 14 is fixed to the cover 350, such as by adhesives, mechanical fasteners, and the like. In the embodiment disclosed herein, the bladder 14 is fixed to the cover 350 by adhesively fixing a portion of the bladder 14 to the cover lid 353 and by fixing the inflation valve 12 relative to the base 351. Fingers 365 formed part of the base 351 engage and hold the inflation valve 12 by a snap fit. Alternatively, the object can be attached directly to the bladder 14, such as disclosed above, by straps that extend through openings (not shown) formed in the cover 350. The straps can be sized to plug the opening and form a water tight seal. Although fixing the cover 350 relative to the bladder 14 is preferred, the cover 250 can be separable from the bladder 14 without departing from the scope of the invention. Of course, if the cover 350 is not fixed relative to the bladder 14, such as by forming the openings between the base and lid edges 361, once the bladder 14 inflates the cover 350 will fall away and may not be available for reuse.

A cut-off valve 370 extending through the hard cover 350 allows water to enter the water tight enclosure 363 to actuate the inflation valve 12. Preferably, the cut-off valve 370 has an open position and a closed position. In the open position, water enters the water tight enclosure 363 through the cut-off valve 370. In the closed position, water is blocked from passing through the cut-off valve 370 into the water tight enclosure 363 which allows the user to submerge the flotation device 310 without actuating the inflation valve 12. The cut-off valve 370 can be any valve known in the art, such as a twist valve that requires a simple twist to open and close, a pull valve that is opened and closed by pulling or pushing on a stem, and the like, without departing from the scope of the invention.

In use, the cut-off valve 370 is set to its open position. Upon immersion of the flotation device 310 in water, water flows through the cut-off valve 370 into the water tight enclosure 363 and actuates the inflation valve 12. The inflation valve 12 inflates the bladder 14 which forces the base 351 and lid 353 apart to allow further expansion of the bladder 14 and form an effective flotation device.

In yet another embodiment, the flotation device includes a location device that transmits a signal, such as a radio transmission, sound, light, and the like, to guide searchers looking for the object attached to the flotation device. The location device can be electronic devices, such as an EBIRP, horn, light, and the like, that are activated upon actuation of the inflation valve. Of course, a location device that can also be activated independent of the inflation valve either automatically, or at the discretion of the user, can be used without departing from the scope of the claims.

In yet another embodiment of the present invention, the flotation device includes a foaming agent, such as a polyurethane, that expands into a foam upon actuation of the inflation valve. The foaming agent can be expelled into the bladder, such that the bladder contains the foam. Advantageously, including a foaming agent allows the bladder to expand even if the bladder is not airtight. Alternatively, if the foaming agent selected remains a substantially single piece of foam upon expansion, it can be expelled into an inflatable assembly not containing a bladder.

While there have been shown and described what is at present considered the preferred embodiments of the invention, it will be obvious to those skilled in the art that various changes and modifications can be made therein without departing from the scope of the invention defined by the appended claims. For example, although a flotation device including a water actuated inflation valve or manually actuated inflation valve to inflate the bladder are preferred embodiments, the inflation valve can be any type known in the art, such as pressure actuated, electronically actuated via a remote transmitter, temperature actuated, and the like without departing from the scope of the invention.

I claim:

1. A flotation device comprising:

a bladder having an inflatable volume;

a cover joined to said bladder to form an inflatable assembly, wherein said cover includes a first portion sealingly engaging a second portion, wherein upon inflation of said bladder, said first portion disengages from said second portion to allow expansion of said bladder; and an inflation valve in fluid communication with said inflatable volume, wherein said inflatable assembly wraps over said inflation valve to form a protective cavity covering said inflation valve.

2. The flotation device as in claim 1, in which said inflation valve is actuated by a pull cord connected to said inflation valve.

3. The flotation device as in claim 1, in which a window formed in said cover allows a user to determine the status of said inflation valve.

4. The flotation device as in claim 1, in which said cover is formed from a hard case.

5. The flotation device as in claim 1, in which said inflation valve is a water actuated inflation valve.

6. The flotation device as in claim 5, in which said water actuated inflation valve has an operable state and an inoperable state, wherein in said inoperable state, said water actuated inflation valve is not actuated by water.

7. The flotation device as in claim 5, in which said cover is water tight, and a cut-off valve extending through said cover has an open position and a closed position, wherein in said open position, water can flow through said cut-off valve and actuate said water actuated inflation valve.

8. The flotation device as in claim 1, including a compressed gas supply in fluid communication with said inflation valve for inflating said inflatable volume upon actuation of said inflation valve.

9. A flotation device comprising:

a bladder forming part of an inflatable assembly and having an inflatable volume; and a water actuated inflation valve in fluid communication with said inflatable volume, wherein said inflatable assembly wraps over said inflation valve to protect said inflation valve; and a cover forming part of the inflatable assembly enclosing said bladder is water tight, and a cut-off valve extending through said cover has an open position and a closed position, wherein in said open position, water can flow through said cut-off valve and actuate said water actuated inflation valve.

10. The flotation device as in claim 9, in which said cover is joined to said bladder.

11. A flotation device comprising:

a bladder forming part of an inflatable assembly and having an inflatable volume; and a inflation valve in fluid communication with said inflatable volume, wherein said inflatable assembly wraps over said inflation valve to protect said inflation valve; and a window formed in said inflatable assembly over said inflation valve, wherein said window allows a user to determine the status of said inflation valve.

12. The flotation device as in claim 10, in which said cover is formed from a hard case.

13. The flotation device as in claim 12, in which said case includes a first portion sealingly engaging to a second portion, wherein upon inflation of said bladder, said first portion disengages from said second portion to allow expansion of said bladder.

14. The flotation device as in claim 9, in which said water actuated inflation valve has an operable state and an inoperable state, wherein in said inoperable state, said water actuated inflation valve is not actuated by water.

15. The flotation device as in claim 9, in which said inflation valve is actuated by a pull cord connected to said inflation valve.

16. The flotation device as in claim 9, including a compressed gas supply in fluid communication with said water actuated inflation valve for inflating said inflatable volume upon actuation of said water actuated inflation valve.

17. The flotation device as in claim 9 in which said inflatable assembly wraps over said inflation valve to form a protective cavity covering said inflation valve to protect said inflation valve.

* * * * *